US007731436B2

(12) United States Patent
Lee et al.

(10) Patent No.: US 7,731,436 B2
(45) Date of Patent: Jun. 8, 2010

(54) IMAGE FORMING APPARATUS WITH THERMAL PRINTING HEAD AND PRINTING METHOD THEREOF

(75) Inventors: Yong-duk Lee, Gunpo-si (KR); Jong-sung Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 588 days.

(21) Appl. No.: 11/485,507

(22) Filed: Jul. 13, 2006

(65) Prior Publication Data

US 2007/0036600 A1 Feb. 15, 2007

(30) Foreign Application Priority Data

Aug. 9, 2005 (KR) ..... 10-2005-0072977

(51) Int. Cl.
*B41J 3/60* (2006.01)
*B41J 3/62* (2006.01)
*B41J 2/01* (2006.01)

(52) U.S. Cl. ..... 400/188; 347/104; 347/197; 347/198; 399/364

(58) Field of Classification Search ..... 400/120.01, 400/120.02, 120.04
See application file for complete search history.

(56) References Cited

U.S. PATENT DOCUMENTS 5,628,503 A * 5/1997 Ishikawa ..... 271/4.1
5,677,722 A 10/1997 Park
6,601,952 B2 * 8/2003 Sugioka et al. ..... 347/104

(Continued)

FOREIGN PATENT DOCUMENTS

CN 1154913 7/1997

(Continued)

OTHER PUBLICATIONS

Chinese Office Action issued on Sep. 5, 2008 in CN2006101106653.

*Primary Examiner*—Judy Nguyen
*Assistant Examiner*—Marissa L Ferguson-Samreth
(74) *Attorney, Agent, or Firm*—Stanzione & Kim, LLP

(57) ABSTRACT

An image forming apparatus using a thermal printing head (TPH) and a printing method thereof to print a borderless image on both sides of a printing medium. The image forming apparatus includes first and second feeding units respectively disposed at front and rear sides of the TPH to transfer the printing medium at a predetermined printing speed and a pair of out-feed rollers that co-rotates and feeds out the printing medium, in which one of the out-feed rollers rotates in contact with the pick-up roller. A platen roller co-rotates in contact with the printing medium fed by the first and second feeding units The TPH has a printing position in which the TPH is pressed towards the platen roller to form a printing nip, and an open position in which the TPH is separated from the platen roller. The knock-up plate has a pick-up position where the printing medium comes in contact with the pick-up roller and a stand-by position where the printing medium loaded thereon is separated from the pick-up roller. The knock-up plate is respectively disposed to the pick-up position and the stand-by position when the TPH is disposed to the printing position and the open position.

7 Claims, 16 Drawing Sheets

U.S. PATENT DOCUMENTS

| | | | | |
|---|---|---|---|---|
| 7,198,419 | B2 * | 4/2007 | Lee | 400/120.16 |
| 7,215,351 | B2 * | 5/2007 | Mindler | 347/176 |
| 2006/0103715 | A1 * | 5/2006 | Haimberger et al. | 347/197 |
| 2006/0175747 | A1 * | 8/2006 | Boleda | 271/264 |

FOREIGN PATENT DOCUMENTS

| | | |
|---|---|---|
| JP | 02-125778 | 5/1990 |
| JP | 07-195769 | 8/1995 |
| KR | 10-2005-0033801 | 4/2005 |

* cited by examiner

IMAGE FORMING APPARATUS WITH THERMAL PRINTING HEAD AND PRINTING METHOD THEREOF

CROSS-REFERENCE TO RELATED APPLICATIONS

This application claims the priority of Korean Patent Application No. 10-2005-0072977, filed on Aug. 9, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus and a printing method thereof, and more particularly, to an image forming apparatus using a thermal printing head (TPH) and a printing method thereof.

2. Description of the Related Art

FIG. 1 is a view illustrating a structure of a conventional image forming apparatus. Referring to FIG. 1, a spring 1 pushes a thermal printing head (TPH) 51 towards a platen roller 52 in order to form a printing nip N. A printing medium 10 passes through the printing nip by the use of a feeding means (not shown) to be supplied to a feeding unit 39. The feeding unit 39 feeds the printing medium 10 at a predetermined printing speed. An ink layer (not shown) which renders a predetermined color in response to heat is provided on the printing medium 10. The TPH 51 prints an image on the printing medium 10 by applying heat thereto.

The driving force of a driving motor (not shown) is not transmitted to the platen roller 52. The platen roller 52 co-rotates with the printing medium 10 by a contact force therebetween. For this reason, a non-printing area (NP) corresponding to a distance from the printing nip N to the feeding unit 39 is required at a front edge (or leading edge) portion of the printing medium 10. For borderless printing, the NP must be removed after printing is complete. Therefore, a user inconveniently has to remove the NP after printing. In addition, a length of the printing medium 10 is extended as long as the NP, increasing the price of the printing medium 10.

SUMMARY OF THE INVENTION

The present general inventive concept provides an image forming apparatus using a thermal printing head (TPH) that can print an image on the whole portion of a printing medium and a printing method thereof.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may also be achieved by providing provided a printing method of an image forming apparatus for printing an image using a TPH by applying heat thereto, the printing method including picking up a printing medium from a cassette using a pick-up roller, supplying the printing medium to a printing nip, where the TPH and a platen roller are faced, using a first feeding unit by feeding the printing medium in a first direction, printing the image onto the printing medium while the printing medium is fed in the first direction at a predetermined printing speed using a second feeding unit, until the front edge of the printing medium passes through the printing nip and reaches to the second feeding unit, feeding the printing medium in the first direction and a second direction that is opposite to the first direction using the second feeding unit after printing is performed up to a rear edge of the printing medium, and printing the image onto an area having no image between a front edge of the printing medium and the printing nip while the printing medium is being fed in the second direction at the predetermined printing speed when the rear edge of the printing medium reaches to the first feeding unit.

The printing method may further include positioning the TPH to face a second side of the printing medium that is opposite to a first side thereof, and printing the image on the second side of the printing medium including the area having no image between the front edge of the printing medium and the printing medium.

The TPH may rotate around the platen roller and is fed to a position facing the first and second sides of the printing medium.

The TPH and the platen roller may be separated from each other in the supplying the printing medium and the feeding the printing medium.

The TPH may have a printing position in contact with the platen roller, a first open position separated from the platen roller by a first gap, and a second open position separated from the platen roller by a second gap that is greater than the first gap, and the TPH is positioned at the first open position.

In The picking up of the printing medium from the cassette using the pick-up roller may include contacting a printing medium loaded on a knock-up plate to the pick-up roller by moving the TPH to the second open position so that a pick-up unit rotates to push up the knock-up plate to a pick-up position, feeding out the printing medium from the cassette by rotating the pick-up roller, and separating the printing medium loaded on the knock-up plate from the pick-up roller after returning the knock-up plate to a stand-by position by moving the TPH to the first open position when the front edge of the printing medium reaches to the first feeding unit.

The foregoing and/or other aspects and utilities of the present general inventive concept may be achieved by providing an image forming apparatus, including a TPH to form an image on a printing medium, a platen roller disposed to form a printing nip with the TPH, and feed rollers provided on a first side and a second side of the TPH along a path that the printing medium travels to feed the print medium across the nip in a first direction and a second direction of the path so that the TPH forms a first portion of the image on a first portion of a first side of the printing medium when the printing medium is fed in the first direction and a second portion of the image on a second portion of the first side of the printing medium where the printing medium is fed in the second direction.

The foregoing and/or other aspects and utilities of the present general inventive concept may be achieved by providing an image forming apparatus having a TPH unit to form images on both sides of a printing medium, the image forming apparatus including a frame having a lateral plate, a supporting bracket rotatably supported by the lateral plate to support a TPH unit, and a rotation cam to control the supporting bracket with respect to the lateral plate to transfer the TPH unit to a first position where the TPH unit can print on a first side of the printing medium and a second position where the TPH unit can print on a second side of the printing medium.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
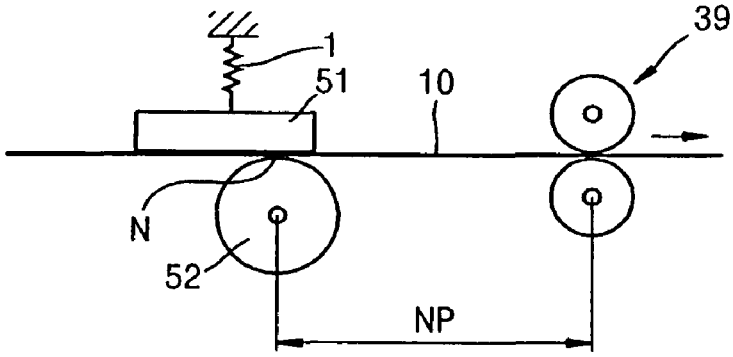
FIG. 1 (PRIOR ART)
FIG. 1 is a view illustrating a structure of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2A:
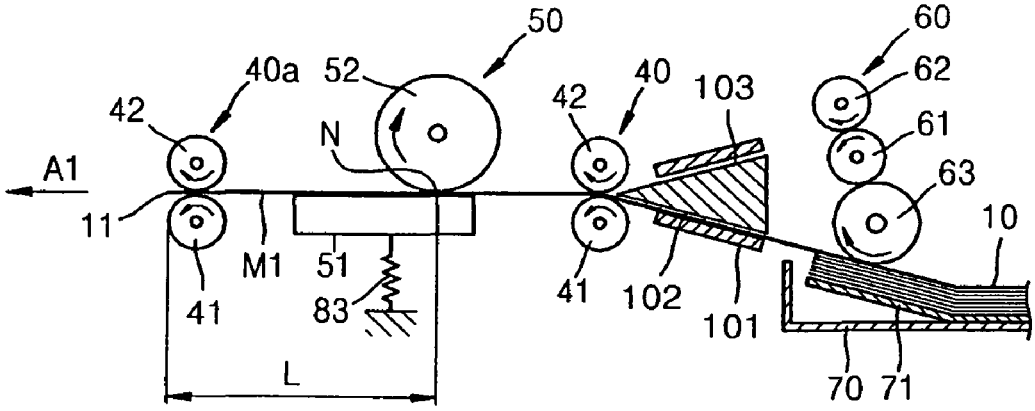
FIGS. 2A to C are views illustrating a borderless printing method of an image forming apparatus using a TPH according to an embodiment of the present general inventive concept.
Figure 2B:
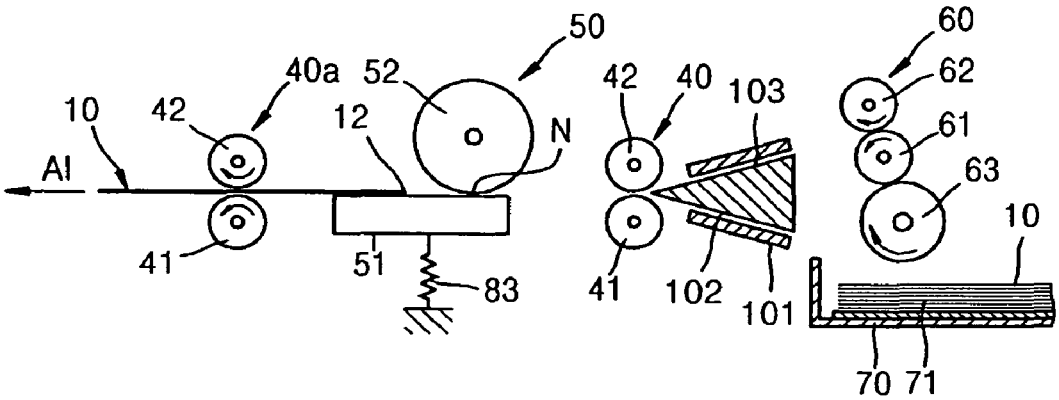
Figure 2C:
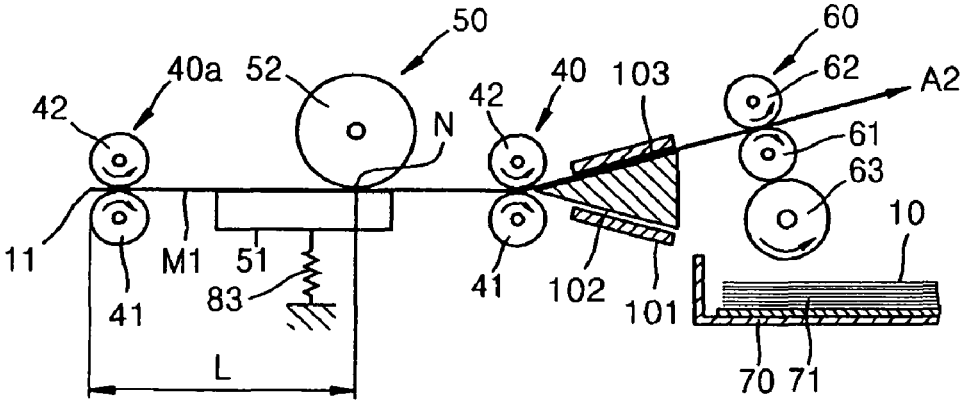

FIGS. 2A to C are views illustrating a borderless printing method of an image forming apparatus according to an embodiment of the present general inventive concept. Referring to FIG. 2A, the image forming apparatus includes a printing unit 50 and first and second feeding units 40 and 40*a*, which are respectively disposed at front and rear sides of the printing unit 50 to feed a printing medium 10 at a predetermined printing speed. The printing unit 50 includes a thermal printing head (TPH) or a TPH unit 51 and a platen roller 52. An elastic member 83 is mounted on a main body of the image forming apparatus to push the TPH 51 towards the platen roller 52. Since the platen roller 52 is in contact with the TPH 51, the platen roller 52 may form a printing nip N with the TPH 51. A knock-up plate 71 is rotatably disposed to a paper loading cassette 70. The printing medium 10 is loaded on the knock-up plate 71. A pick-up roller 63 to pick up the printing medium 10 is disposed on an upper side of the knock-up plate 71. The first and second feeding units 40 and 40*a* feed the printing medium 10 at the predetermined printing speed in first and second directions A1 (FIGS. 2A and 2B) and A2 (FIG. 2C), respectively. The first and second feeding units 40 and 40*a* each include a feeding roller 41 and an idle roller 42 to engage the feeding roller 41. An out-feed unit 60 to feed out the printing medium 10 includes an out-feed roller 61 to co-rotate (or rotate together) with the pick-up roller 63 and an idle roller 62 to be engaged with the out-feed roller 61.

A printing method according to the aforementioned embodiment of the present general inventive concept will be described with respect to FIGS. 1-3. One or more ink layers to render a predetermined color in response to heat is provided at one side M1 (illustrated in FIG. 3) of the printing medium 10. As illustrated in FIG. 2A, the printing medium 10 is picked up from the paper loading cassette 70 by the pick-up roller 63 and then fed in the first direction A1 to be supplied to the printing unit 50 by the first feeding unit 40. When a front edge 11 of the printing medium 10 reaches the second feeding unit 40*a*, the second feeding unit 40*a* feeds the printing medium 10 at the predetermined printing speed in the first direction A1. The TPH 51 prints an image on the one side M1 of the printing medium 10 by applying heat corresponding to image data. As illustrated in FIG. 2B, when a rear edge 12 of the printing medium 10 passes the printing nip N, the feeding of the printing medium 10 is stopped. A driving force of a driving motor (not shown) is not transmitted to the platen roller 52. The platen roller 52 to co-rotate (or rotate together) with the printing medium 10 by a contact force therebetween. Thus, the image is not printed on a front edge portion L (see FIG. 2A) of the printing medium 10, that is, an area between the printing nip N and the front edge 11 of the printing medium 10, when the front edge 11 of the printing medium 10 reaches to the second feeding unit 40*a*.

In order to print the image on the front edge portion L of the printing medium 10, the second feeding unit 40*a* feeds the printing medium 10 in the second direction A2. As illustrated in FIG. 2C, when the front edge portion L of the printing medium 10 reaches the printing nip N, that is, when the rear edge 12 of the printing medium 10 reaches the first feeding unit 40, the first feeding unit 40 feeds the printing medium 10 at the predetermined speed in the second direction A2. The TPH 51 prints the image by applying heat on the front edge portion L of the printing medium 10. When printing is complete, the printing medium 10 is fed out by the out-feed unit 60. A color image may be printed by repeating the aforementioned operation several times so that heat is applied on multiple ink layers in turn. The feed units 40 and 40*a* may be arranged along a print medium travel path. The first feed unit 40 is provided on a first part of the print medium path between the knock-up plate 52 and the TPH 51. The second feed unit 40*a* is provided on a second part of the print medium travel path after the TPH. The first and second directions A1 and A2 may be provided along the print medium travel path. The image forming apparatus may have a switching unit 101 having a first switching path 102 and a second switching path 103 to guide the printing medium 10 from the pick-up roller 63 to the first feeding roller 40 and from the first feeding roller 40 to the out-feed unit 60, respectively.

The pick-up roller 63 to co-rotate (or rotate together) with the out-feed roller 61, and since a rotation direction of the pick-up roller 63 varies, the knock-up plate 71 may be lowered to separate the printing medium 10 loaded thereon from the pick-up roller 63 after the printing medium 10 is picked up and the front edge 11 thereof reaches to the first feeding unit 40. In addition, the platen roller 52 is not rotated by the driving motor (not shown) but rotated in contact with the printing medium 10 fed by the first and second feeding units 40 and 40*a*. When the first and second feeding units 40 and 40*a* feed the printing medium 10 in the first and second directions A1 and A2 to be supplied to the printing unit 50, the TPH 51 may be separated from the platen roller 52, whereas when the first and second feeding units 40 and 40*a* feed the printing medium 10 at the predetermined printing speed in the first and second directions A1 and A2, the TPH 51 may be elastically engaged with the platen roller 52 to form the printing nip N. An apparatus to implement elastically engaging and disengaging the TPH 51 from the platen roll 52 will be described as follows.

In the printing method of the present embodiment, the two feeding units 40 and 40*a* are provided, so that borderless printing is possible from the front edge 11 of the printing medium 10 to the rear edge 12 thereof. Accordingly, there is no need to remove a non-printing area (NP) after printing is complete as in the conventional image forming apparatus illustrated in FIG. 1, and thus a shorter printing medium 10 without the NP can be used.

Figure 3:
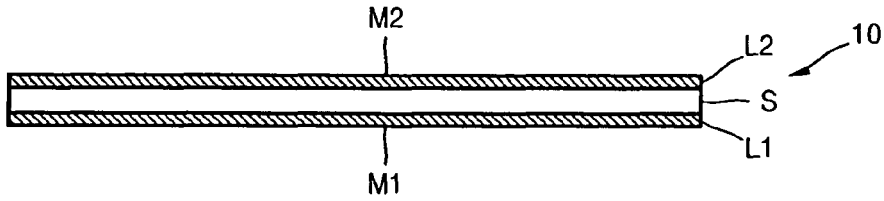
FIG. 3 is a cross-sectional view illustrating a printing medium used in an embodiment of the present general inventive concept.

FIG. 3 is a cross-sectional view illustrating the printing medium 10. Referring to FIG. 3, the printing medium 10 used in the image forming apparatus may have a structure in which ink layers L1 and L2 of a predetermined color are formed on first and second sides M1 and M2 of a base sheet S. The respective ink layers L1 and L2 may have a single layer structure to render a simple color or a multilayer structure to render multiple colors. For example, the ink layer L1 of the first side M1 of the ink layer may have a two-layer structure to render yellow and magenta, while the ink layer L2 of the second side M2 of the ink layer may have a single-layer structure to render cyan. In addition, the ink layers L1 and L2 may render the same color. The printing medium 10 may be a printing medium disclosed in the U.S. Pat. No. US2003/0125206. However, the image forming apparatus according to the present general inventive concept is not limited by the structure of the ink layers of the first and second sides M1 and M2 of the printing medium 10.

Figure 4:
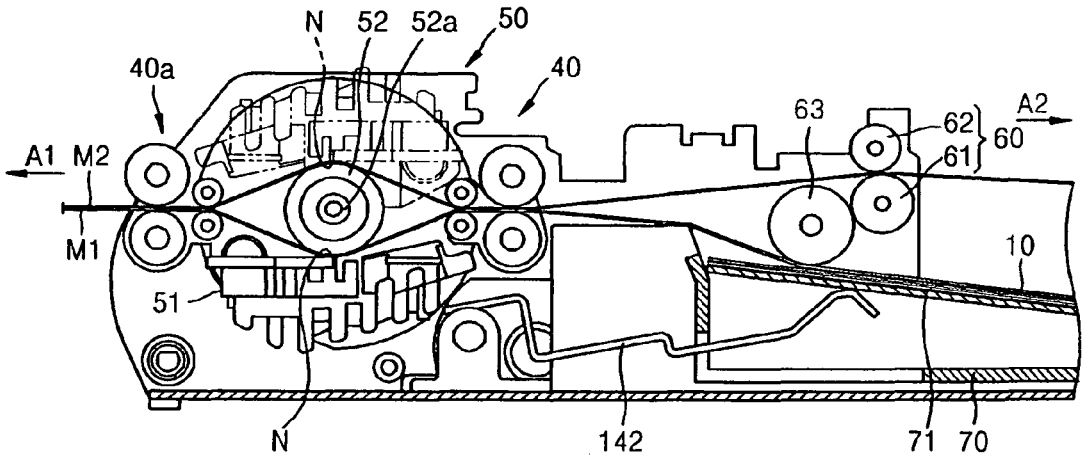
FIG. 4 is a view illustrating a structure of an image forming apparatus capable of duplex printing according to an embodiment of the present general inventive concept.

FIG. 4 is a view illustrating a structure of an image forming apparatus capable of duplex printing according to an embodiment of the present general inventive concept. Referring to FIGS. 2A-4, in order to perform the duplex printing by using one TPH 51, the TPH 51 is fed (moved) to a first position (solid line in FIG. 4) to face the first side M1 of the printing medium 10, and a second position (dotted line in FIG. 4) to face the second side M2 of the printing medium 10. The TPH 51 is in a printing position to face the platen roller 52 so that the printing nip N is formed, in a first open position, where the platen roller 52 is separated by a first gap, and in a second open position, where the platen roller 52 is separated from the TPH 51 by a second gap that is greater than the first gap. The printing medium 10 loaded on the knock-up plate 71 comes in contact with the pick-up roller 63 when the pickup operation is performed, whereas the printing medium 10 loaded on the knock-up plate 71 may be separated from the pick-up roller 63 when the pickup operation is complete. To this end, the knock-up plate 71 is lifted to a pick-up position where the printing medium 10 loaded thereon comes in contact with the pick-up roller 63 and to a stand-by position where the printing medium 10 is separated from the pick-up roller 63 when the knock-up plate 71 is lowered. The knock-up plate 71 can be positioned in the pick-up position when the TPH 51 is positioned in the second open position, while is the knock-up plate 71 may be positioned in the stand-by position when the TPH 51 is positioned in the first open position.

Figure 5:
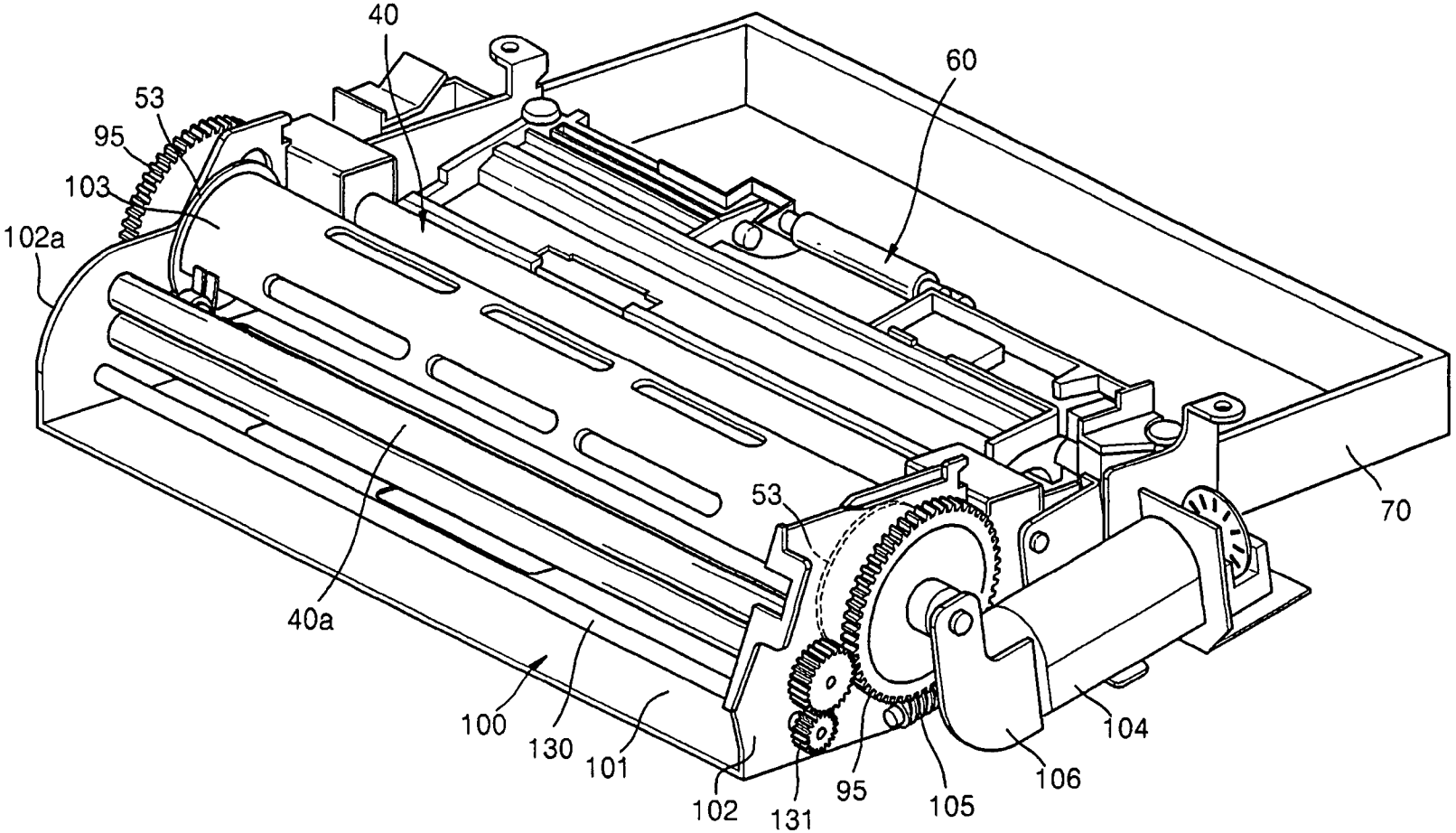
FIG. 5 is a perspective view illustrating the image forming apparatus of FIG. 4.
Figure 6:
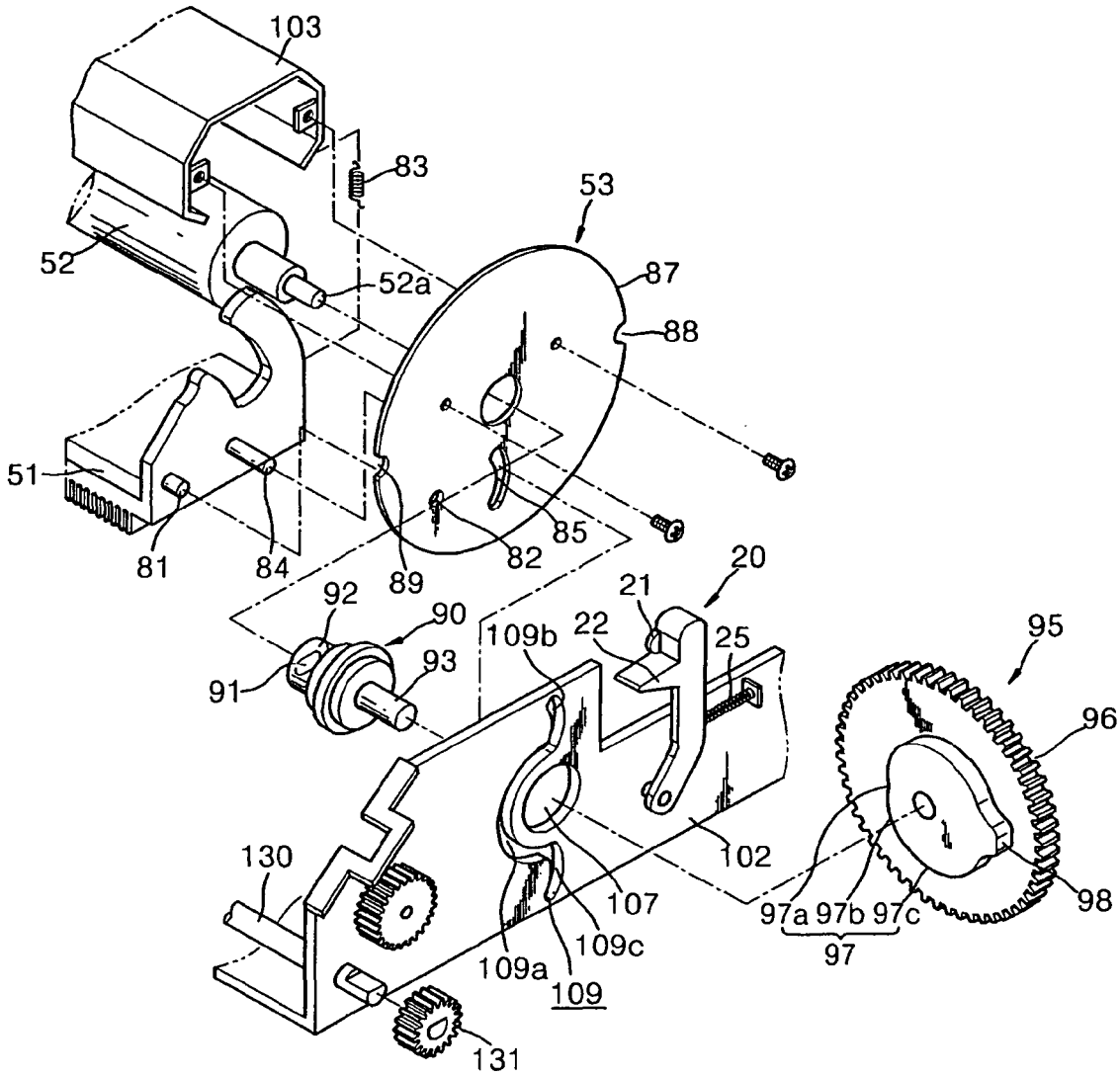
FIG. 6 is a partially exploded perspective view illustrating the image forming apparatus of FIG. 4.

FIGS. 5 and 6 are a perspective view and a partially exploded perspective view illustrating the image forming apparatus of FIG. 4. Referring to FIGS. 5 and 6, a frame 100 includes a bottom base 101 and two lateral plates 102 and 102*a* extending up from both lateral sides of the bottom base 101. The printing unit 50, the first and second feeding units 40 and 40*a*, the out-feed unit 60, the pick-up roller 63, and the cassette 70 are disposed in the frame 100. Although not shown, the driving motor may be joined with the side-plate 102*a*.

A hinge shaft 81 and a cam lever 84 are provided at both sides of the TPH 51. Bushings 90 are joined in a hole 107 formed in the lateral plates 102 and 102*a*. The bushings 90 include an inner circumference 91 and a first outer circumference 92. Both ends 52*a* of the platen roller 52 are inserted into the corresponding inner circumference 91 of the two bushings 90 joined with the lateral plates 102 and 102*a*. A pair of supporting brackets 53 is rotatably joined in the corresponding first outer circumference 92 of the bushings 90. The hinge shaft 81 is inserted into a hinge hole 82 included in the corresponding supporting bracket 53. The TPH 51 is joined with the pair of supporting brackets 53 in a rotatable manner about the hinge hole 82.

The bushings 90 further include a second outer circumference 93 which is coaxial with the first outer circumference 92. A pair of rotation cams 95 is rotatably joined in the corresponding second outer circumference 93 of the bushings 90. The pair of rotation cams 95 includes a gear 96 and a cam 97 which is in contact with the cam lever 84. The cam 97 includes first, second, and third cam surfaces 97*a*, 97*b*, and 97*c* which are eccentrically disposed with respect to a rotation axis of the rotation cam 95. The rotation axis is disposed along a longitudinal axis of the second outer circumference 93. The first, second, and third cam surfaces 97*a*, 97*b*, and 97*c* are associated with the printing position, the first open position, and the second open position of the TPH 51, respectively. A stopper 98 is included in one of or both of the pair of rotation cams 95. The stopper 98 is disposed at an end portion of the third cam surfaces 97*c*. The cam 97 is symmetrically formed so that the stopper 98 and the first, second, and third cam surfaces 97*a*, 97*b*, and 97*c* are provided on both halves of the cam 97. A cam motor 104 includes a worm gear 105 which is engaged with the gear 96. A bracket 106, which is joined with the cam motor 104, is joined with the side-plate 102. Accordingly, the pair of supporting brackets 53 and the pair of rotation cams 95 have the same rotation axis. When the stopper 98 comes in contact with the cam lever 84, the rotation cams 95 are no longer rotatable and a driving current of the cam motor 104 driving the rotation cam 95 is increased. The first position of the rotation cam 95 can be seen by detecting the driving current. A cam groove 109 may be formed in the side plates 102 disposed opposite to each other with respect to the TPH 51. The cam lever 84 is disposed in the cam groove 109 and the through hole 85. The cam groove 109 may have a first groove part 109*a* formed around a circumferential direction of the hole 107 to provide a path of the cam lever 84 when the rotation cam 95 controls the TPH 51 to rotate between the first and second positions. The cam groove 109 has second groove parts 109*b* and 109*c* provided in a second direction to receive the cam lever 84 when the rotation cam 95 controls the TPH 51 to change in position to the first and second open positions and the printing position. The cam groove parts 109*a*, 109*b*, and 109*c* define a path that the TPH 51 travels and changes in its position when the cam 97 rotates.

A rotation guide 103 is joined with the pair of the supporting brackets 53. The rotation guide 103 guides the printing medium 10, which is supplied from the feeding units 40 and 40*a*, to a position between the TPH 51 and the platen roller 52. A tensile coil spring may be used as the first elastic member 83, one end of which is connected to the TPH 51 and the other end of which is connected to the rotation guide 103 to cover the platen roller 52. The rotation guide 103 includes guide portions disposed opposite to each other with respect to the platen roller 52 in a feeding direction of the printing medium 10 to guide the printing medium 10. The cam lever 84 is inserted into a through-hole 85 formed in the supporting bracket 53. In order to allow the TPH 51 to pivot, the through-hole 85 may have a circular arc shape of which center is at the hinge hole 82.

A pair of gears 131, which are engaged with the corresponding gear 96 of the pair of rotation cams 95, are joined to corresponding ones of both ends of a shaft 130. Accordingly, when the cam motor 104 rotates, the pair of rotation cams 95 also rotates.

The supporting bracket 53 may have a circular outer circumference 87. First and second joining notches 88 and 89 are formed and separated from each other by 180 degrees along the outer circumference 87. A locking member 20 is rotatably joined in the side-plate 102. A compression spring 25 generates an elastic force in a direction where the first and second joining notches 88 and 89 are joined with the locking member 20. The locking member 20 is separated from the first and second joining notches 88 and 89 by the rotation cam 95 and is joined with the first and second joining notches 88 and 89 by the elastic force of the compression spring 25. The locking member 20 includes a protrusion 21, which is joined with the first and second joining notches 88 and 89, and a snag 22 which interferes with the cam 97 attached to the rotation cam 95. The locking member 20 and the compression spring 25 may be installed in the side-plate 102*a*. When the supporting bracket 53 is disposed opposite to the rotation cam 95 with respect to the side plate 102, the protrusion 21 protrudes from a lever portion of the locking member 20 toward the circular outer circumference 87, and the snag 22 protrudes from the lever portion of the locking member 20 toward the cam 97. The side plates 102 includes the cam groove 109 formed thereon to correspond to a movement of the cam lever 84 which moves according to a movement of the rotation cam 95.

Figure 7:
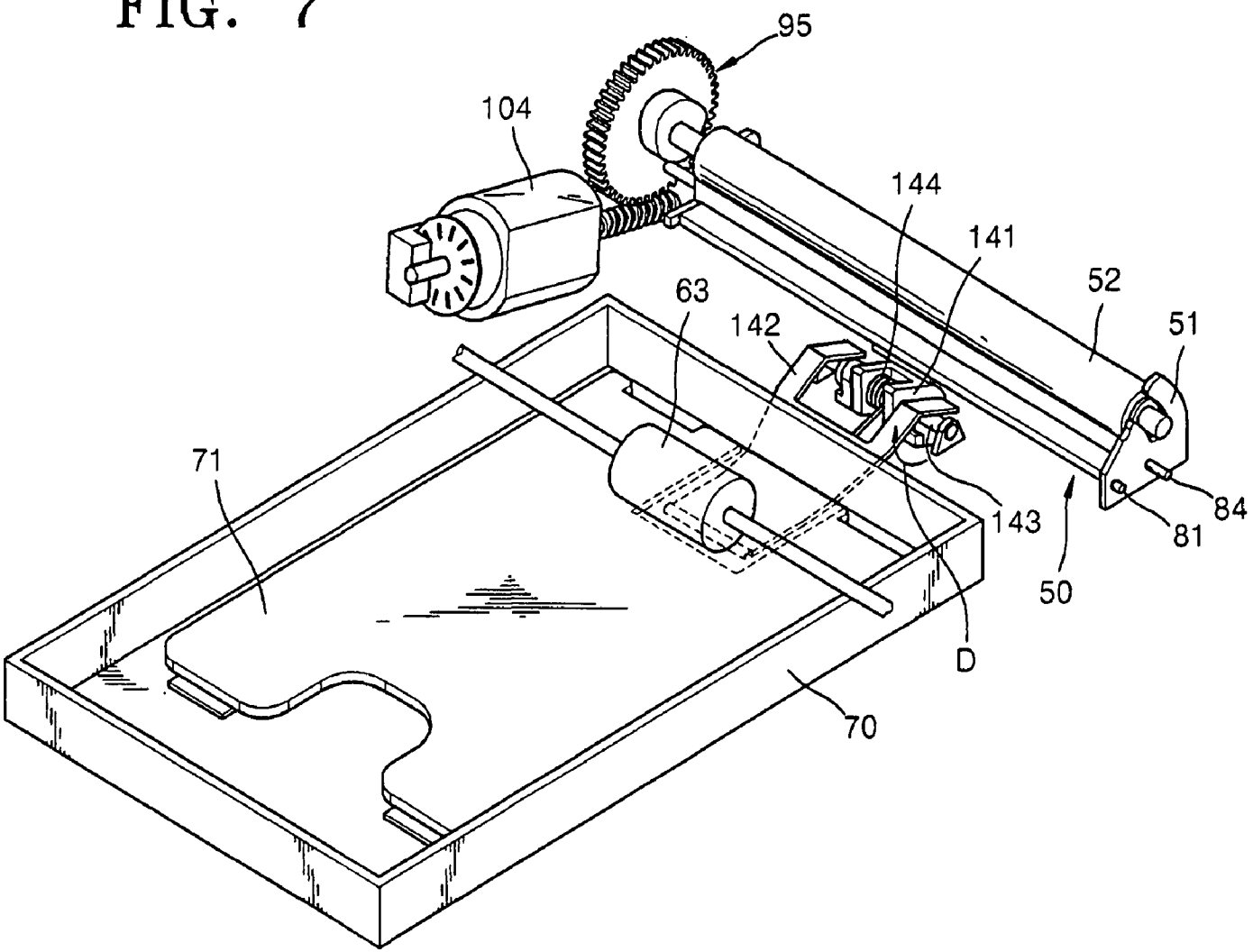
FIG. 7 is an exploded perspective view illustrating a pick-up unit to lift a knock-up plate to a pick-up position and a stand-by position of the image forming apparatus of FIG. 4.

FIG. 7 is an exploded perspective view illustrating a pick-up unit to lift the knock-up plate 71 to the pick-up position and the stand-by position according to an embodiment of the present general inventive concept. Referring to FIG. 7, the pick-up unit includes first and second arms 141 and 142 and a spring (elastic member) 144. The first arm 141 is extended downward to the TPH 51. The second arm 142 is extended downward to the knock-up plate 71. The spring (elastic member) 144 elastically connects the first and second arms 141 and 142. One end of the spring 144 is supported by the first arm 141, and the other end thereof is supported by the second arm 142. When the TPH 51 pivots from the printing position toward the first open position, the first arm 141 does not come in contact with the TPH 51 so that the pickup unit is in the standby position. When the TPH 51 pivots toward the second open position, the TPH 51 pushes the first arm 141 so that the pickup unit is in the pickup position. For example, a portion of the TPH 51 contacts the first arm 141 when the cam lever 84 moves within the through hole 85. As a result, the first arm 141, the spring 144, and the second arm 142 rotate about a pivot 143. The second arm 142 pushes the knock-up plate 71 toward the pick-up roller 63. The printing medium 10 loaded on the knock-up plate 71 is elastically in contact with the pick-up roller 63 by an elastic force of the spring 144. When the TPH 51 pivots from the second open position to the first open position, the first and second arms 141 and 142 and the spring 144 are returned to their first positions according to the weights of the knock-up plate 71 and the printing medium 10 loaded thereon. When the TPH 51 is in the second position, the pickup unit may be in the standby position. In this case, the pickup unit may not move between the stand-by position and the pick-up position.

The printing method of the image forming apparatus will be described with reference to the drawings hereinafter.

Figure 8A:
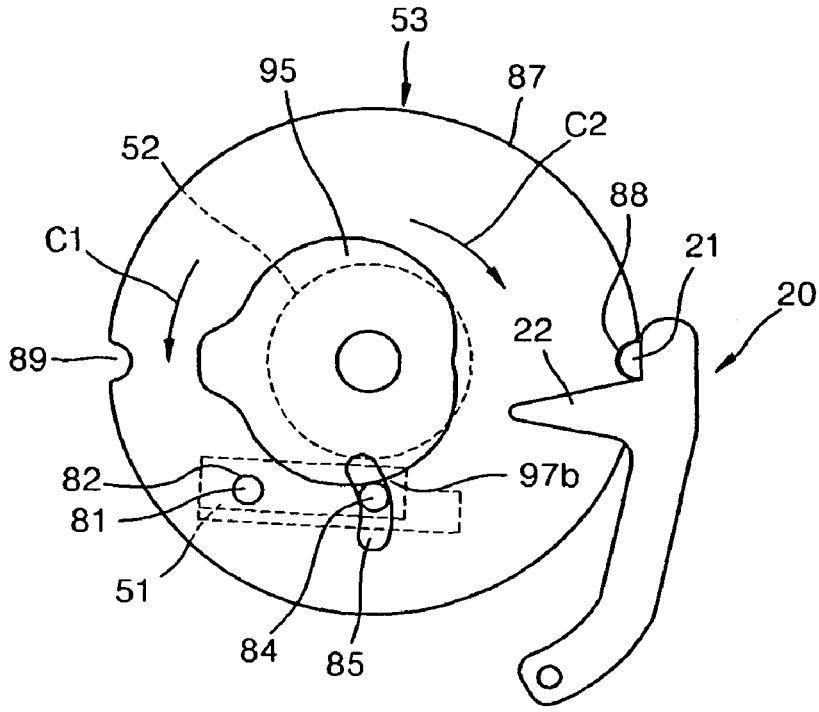
FIGS. 8A to G are views illustrating an operation to feed the TPH to first and second positions respectively facing first and second sides of a printing medium, a printing position in contact with a platen roller, and first and second open positions separated from the platen roller by first and second gaps of the image forming apparatus of FIG. 4.
Figure 8B:
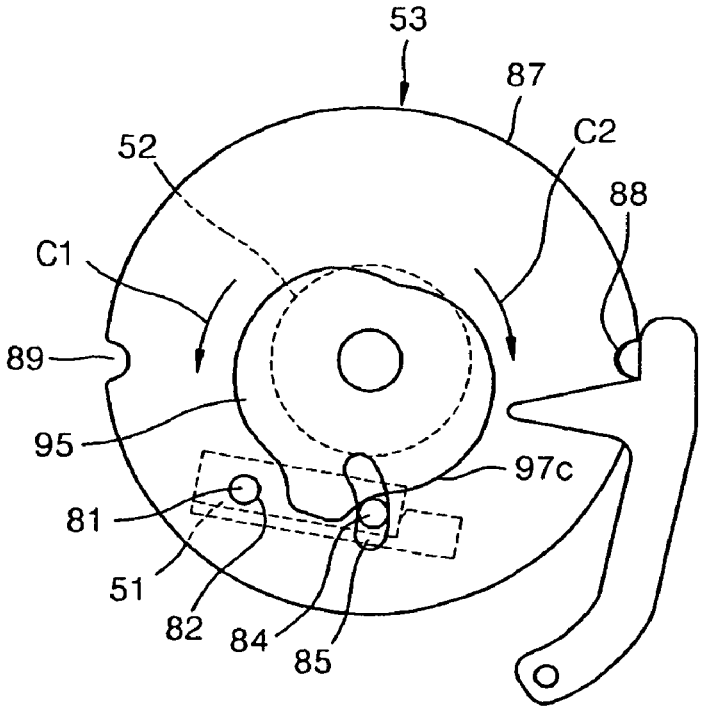
Figure 8C:
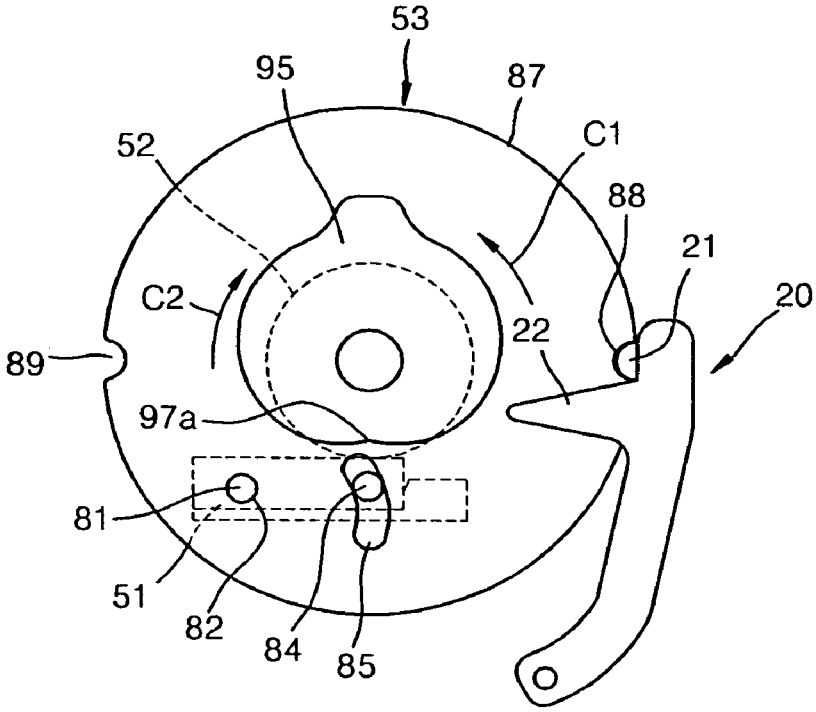
Figure 8D:
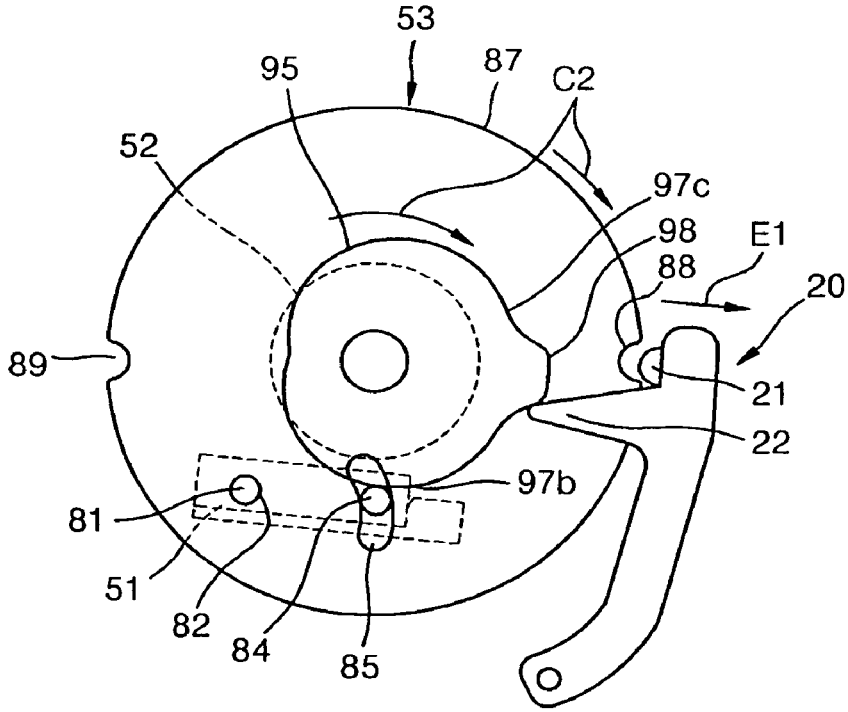
Figure 8E:
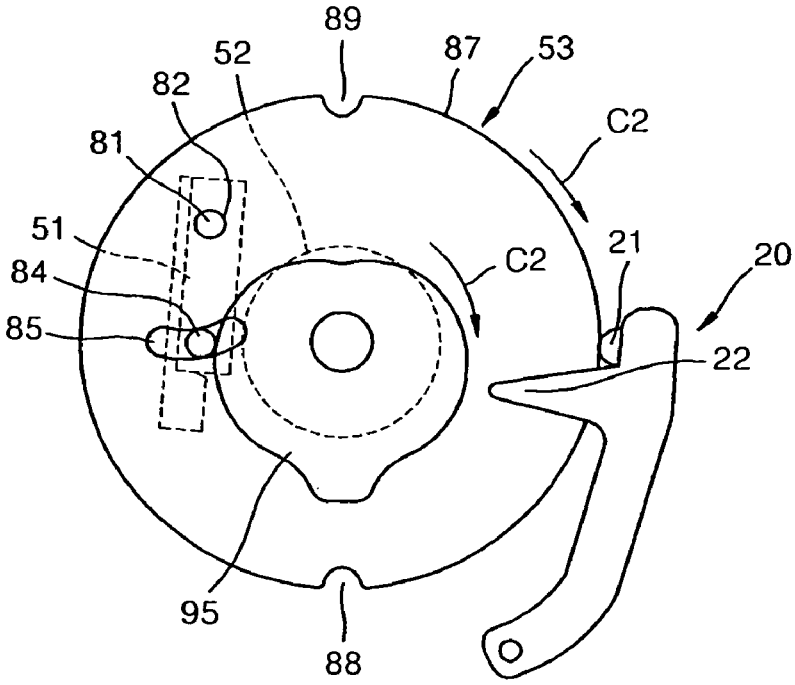
Figure 8F:
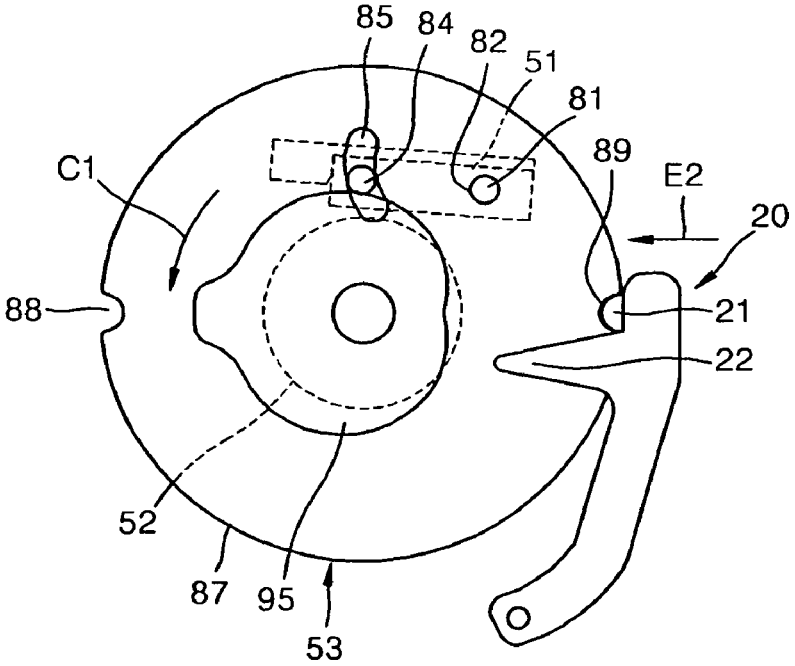
Figure 8G:
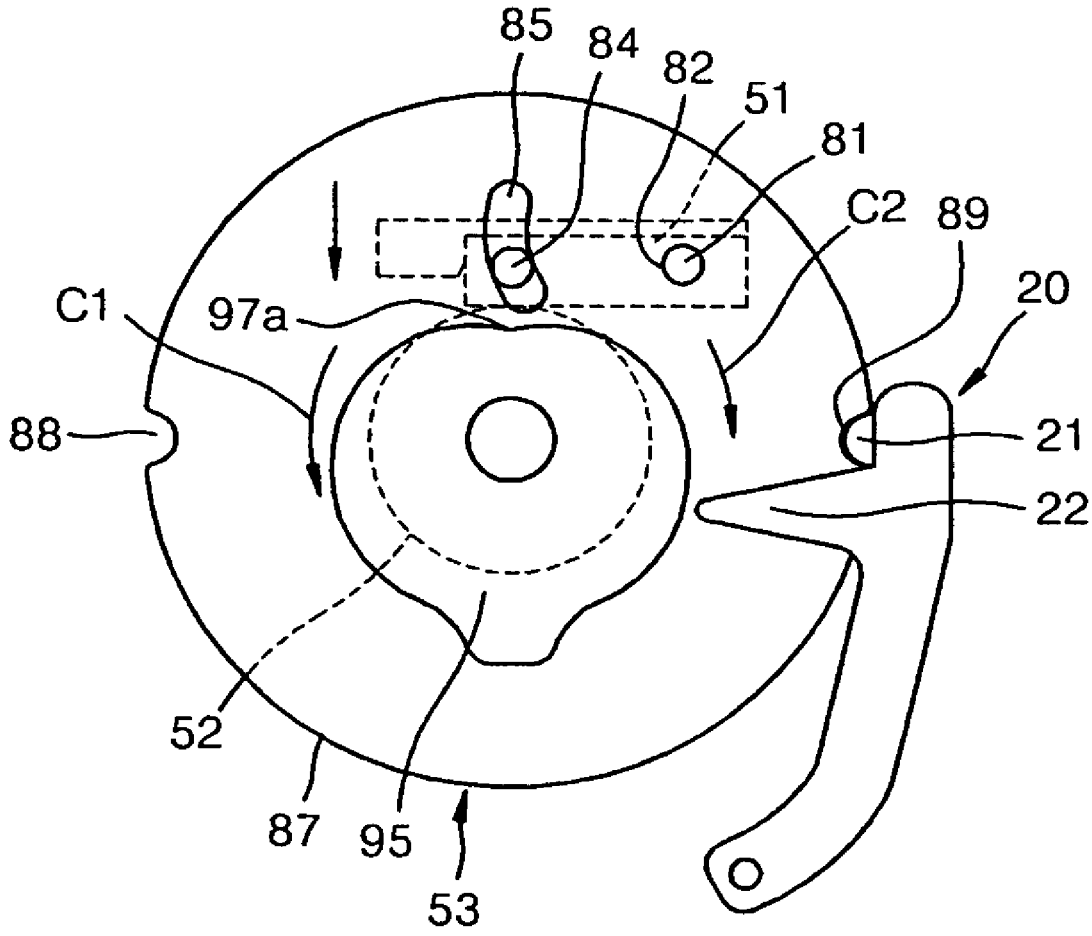
Figure 9A:
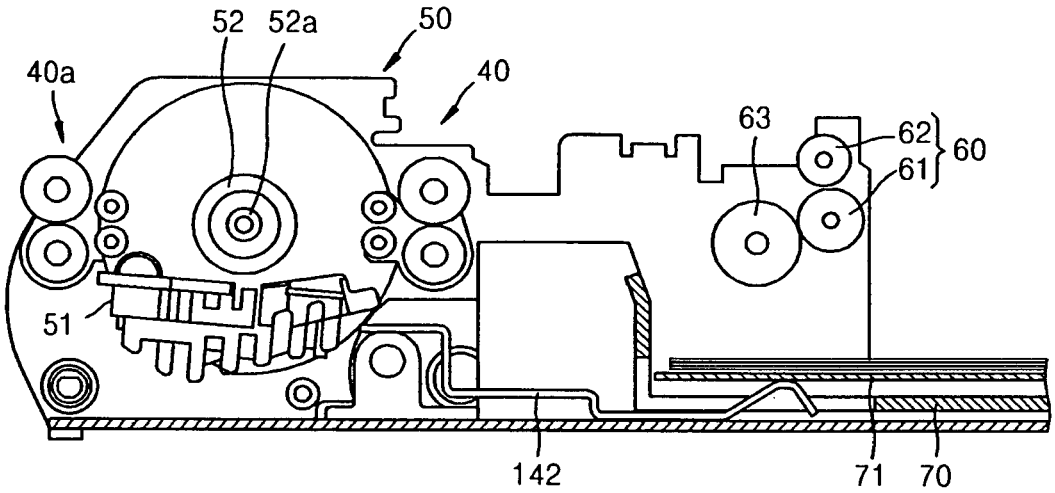
FIGS. 9A to L are views illustrating a borderless printing method of the image forming apparatus of FIG. 4.

FIGS. 8A to 8G are views illustrating an operation to feed the TPH 51 to the first and second positions respectively facing the first and second sides M1 and M2 of the printing medium 10, the printing position in contact with the platen roller 52, and the first and second open positions separated from the platen roller 52 by the first and second gaps in the image forming apparatus of FIG. 4. FIGS. 9A to 9L are views illustrating the borderless printing method of the image forming apparatus of FIG. 4. Referring to FIGS. 8A and 9A, the cam lever 84 is in contact with the second cam surface 97*b*. As a result, the TPH 51 is positioned in the first open position, the TPH 51 is separated from the platen roller 52 by the first gap G1. In addition, as the protrusion 21 of the locking member 20 is caught in the first joining notch 88, the TPH 51 is locked in the first position. Since, the first arm 141 is separated from the TPH 51, the knock-up plate 71 is in a lower position, so that the printing medium 10 is separated from the pick-up roller 63 in the standby position.

Figure 9B:
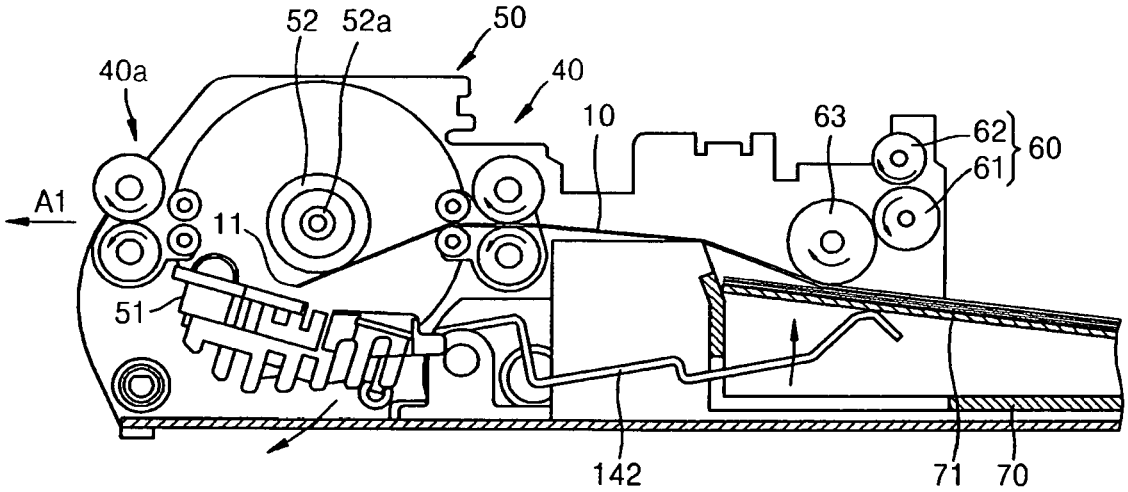

The cam 95 rotates within a first predetermined angle in which the cam 95 rotates to control the TPH 51 to move to the first and second open position and the print position. The rotation of the cam 95 causes the first, second, and third cam surfaces 97*a*, 97*b*, and 97*c* to contact the cam lever 84 and move the TPH 51. In order to pick up the printing medium 10, referring to FIGS. 8B and 9B, the rotation cam 95 rotates in a direction C1. Since the supporting bracket 53 is locked by the protrusion 21 of the locking member 20, the supporting bracket 53 does not rotate while the cam lever 84 moves with respect to the hinge shaft 81 within the through hole 85. The third cam surface 97*c* pushes the cam lever 84 so that the TPH 51 pivots toward the second open position, where the TPH 51 is separated from the platen roller 52 by the second gap G2. As shown in FIG. 9B, the TPH 51 pushes the first arm 141 so that the first and second arms 141 and 142 rotate. The second arm 142 pushes the knock-up plate 71 toward the pick-up roller 63. The knock-up plate 71 is positioned in the pick-up position. The printing medium 10 loaded on the knock-up plate 71 is elastically in contact with the pick-up roller 63 by the elastic force of the spring 144.

Figure 9C:
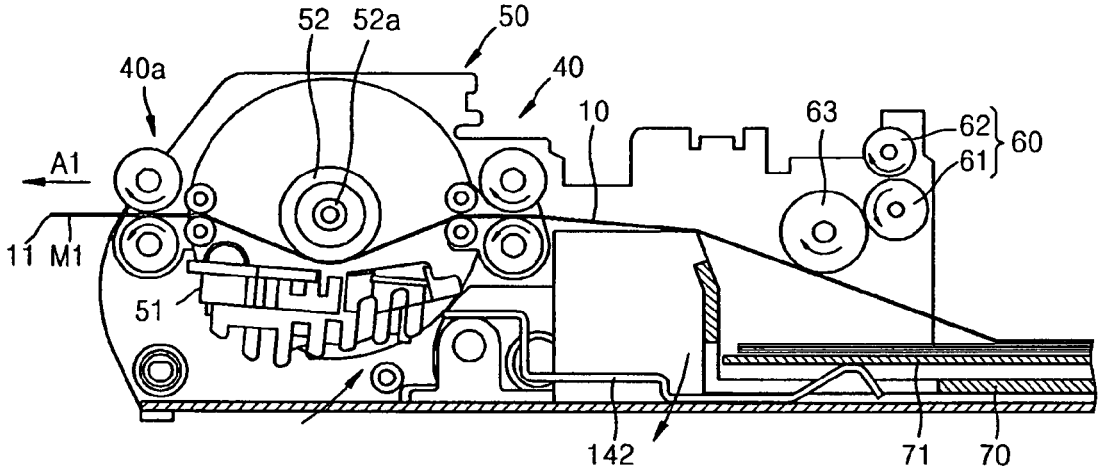

The pick-up roller 63 feeds out the printing medium 10 from the cassette 70, and the printing medium 10 is fed toward the feeding unit 40. When the printing medium 10 is fed toward a first feed position where the first feeding unit 40 can feed the printing medium 10, the rotation cam 95 rotates in a direction C2. Then, the TPH 51, the first and second arms 141 and 142, and the knock-up plate 71 are returned to the positions shown in FIG. 9A. Referring to FIG. 9C, in the first feeding unit 40, the printing medium 10 passes between the TPH 51 and the platen roller 52 through the first gap G1 and is fed to the second feeding unit 40*a*. As the pick-up roller 63 and the printing medium 10 loaded on the knock-up plate 71 are separated from each other, the printing medium 10 is not picked up even if the pick-up roller 63 rotates.

Figure 9D:
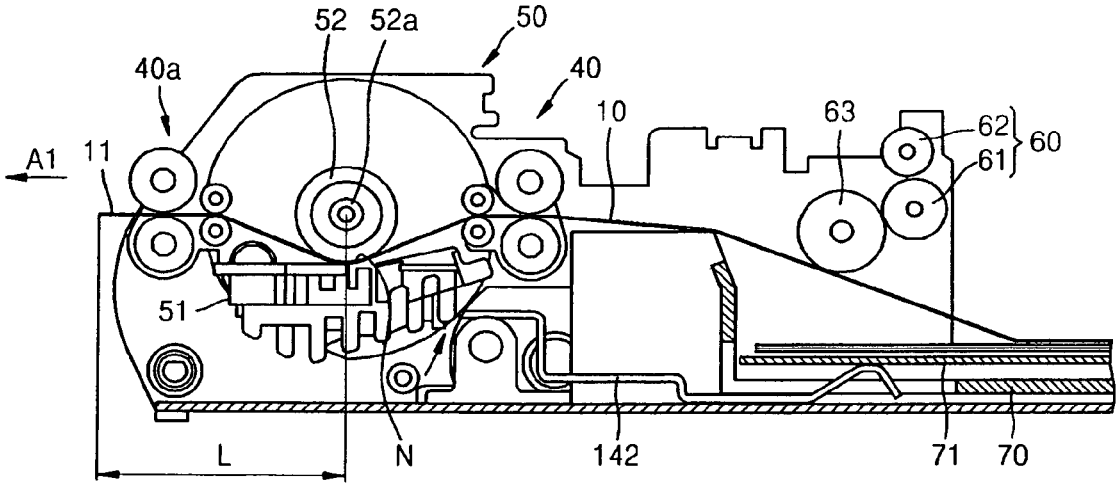
Figure 9E:
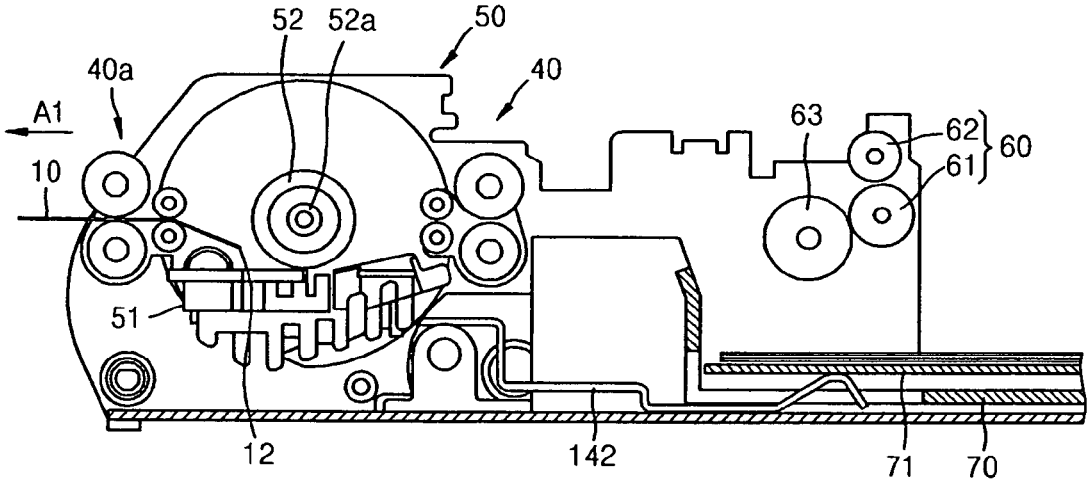

When the front edge of the printing medium 10 reaches to the second feeding unit 40*a*, the rotation cam 95 rotates in the direction C2 from a state shown in FIG. 8A in order to pivot the TPH 51 toward the printing position. Since the protrusion 21 of the locking member 20 is joined with the first joining notch 88, the supporting bracket 53 does not rotate. The cam lever 84 faces the first cam surface 97*a*, and the TPH 51 rotates about the hinge shaft 81 by the elastic force of the first elastic member 83 so that it is positioned in the printing position to form the printing nip N between the TPH 51 and the platen roller 52 as shown in FIGS. 8C and 9D. Here, the first cam surface 97*a* and the cam lever 84 may be separated from each other. The second feeding unit 40*a* feeds the printing medium 10 in the first direction A1. The TPH 51 prints an image by heating the first side M1 of the printing medium 10. Referring to FIG. 9E, when the rear edge 12 of the printing medium 10 passes the printing nip N, the printing medium 10 is stopped. At this time, the image is not printed on the front edge portion L of the printing medium 10, that is, the area between the printing nip N and the front edge 11 of the printing medium 10, when the printing medium 10 reaches to the second feeding unit 40*a*.

Figure 9F:
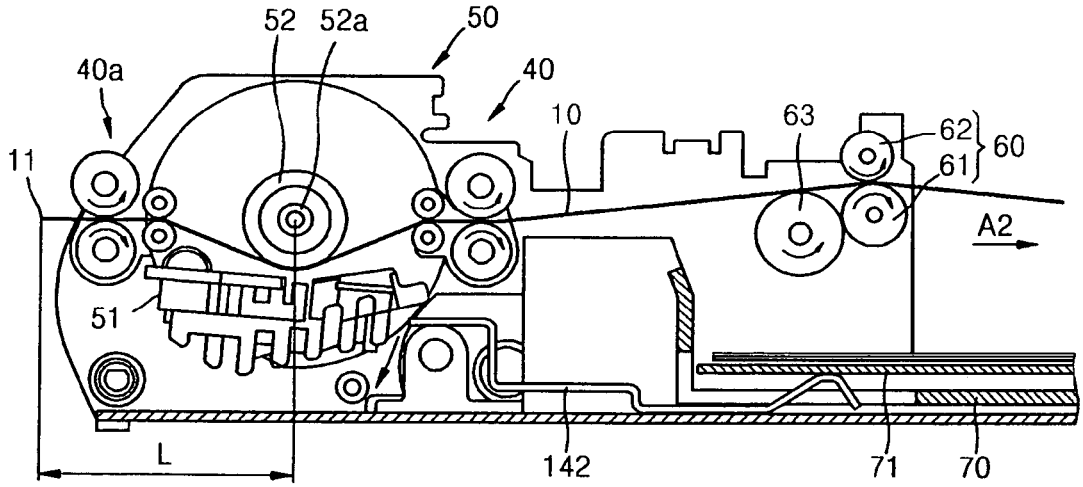
Figure 9G:
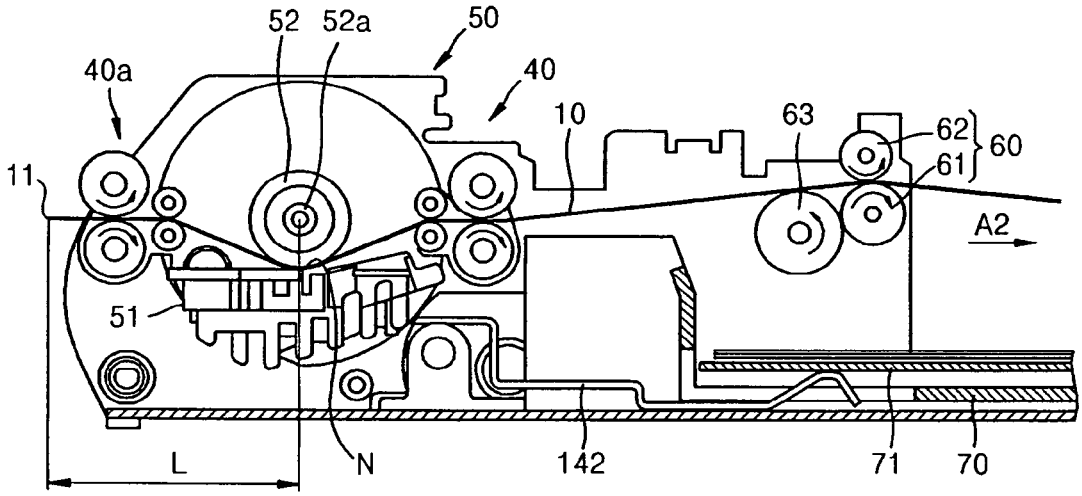

The image is printed on the front edge portion L of the printing medium 10 by following operations. Referring to FIG. 8C, the rotation cam 95 rotates in the direction C1 to return to the state shown in FIG. 8A so that the TPH 51 is positioned at the first open position. Referring to FIG. 9F, the second feeding unit 40*a* feeds the printing medium 10 in the second direction A2. When the front edge portion L of the printing medium 10 reaches to the printing nip N, the printing medium 10 is stopped. The rotation cam 95 rotates again from the state shown in FIG. 8A to the state shown in FIG. 8D, such that the TPH 51 is positioned at the printing position shown in FIGS. 8C and 9G to form the printing nip N between the TPH 51 and the platen roller 52. The first feeding unit 40 feeds the printing medium 10 in the second direction A2 at the predetermined printing speed. The TPH 51 prints the image by applying heat on the front edge portion L of the printing medium 10. When printing is complete on the first side M1 of the printing medium 10, the printing medium 10 is fed out by the out-feed unit 60 shown in FIG. 9H. When the rotation cam 95 rotates in a predetermined angle in the directions C1 and C2 as illustrated in FIG. 8A or 8C, the supporting bracket 53 does not rotate since the cam lever 84 moves into the through hole 85 and the cam groove 109 according to a radius of the first, second, and third cam surfaces 97*a*, 97*b*, and 97*c* about a rotation axis of the rotation cam 95.

Figure 9H:
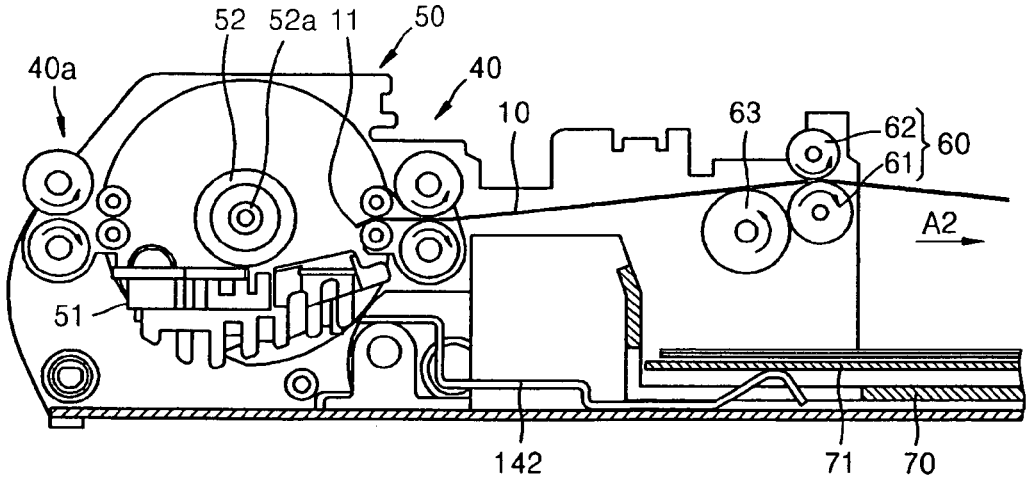
Figure 9I:
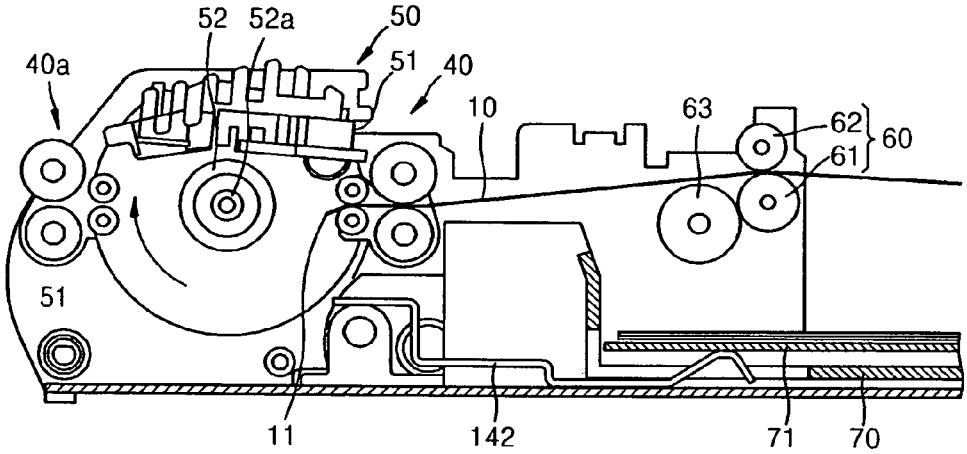

Referring to FIG. 9H, the printing medium 10 is stopped before the front edge 11 of the printing medium 10 is fed out of the first feeding unit 40. For printing on the second side M2 of the printing medium 10, the TPH 51 is now fed to the second position facing the second side M2 of the printing medium 10 shown as a dotted line in FIG. 4. When the rotation cam 95 rotates in the direction C2 from the state shown in FIG. 8C in a second predetermined angle greater than the predetermined angle of FIGS. 8A-8C, the third cam surface 97*c* and the stopper 98 push the snag 22 so that the locking member 20 rotates in a direction E1 as shown in FIG. 8D. The cam 97 is in a blocking state when the third cam surface 97*c* pushes against the snag 22 to release protrusion 21 from either the first or second joining notch 89 and 89. As a result, the protrusion 21 is separated from the first joining notch 88 and the supporting bracket 53 is released to be able to rotate freely. Therefore, when the rotation cam 95 continuously rotates in the direction C2 and the second cam surface 97*b* pushes the cam lever 84, the supporting bracket 53 rotates in the direction C2 between the first and second positions, as shown in FIG. 8E rather than controlling the TPH 51 to pivot about the hinge shaft 81 between the first and second open position and the printing position. When the blocking state between the third cam surface 97*c* and the snag 22 ends, the locking member 20 is continuously held in contact with the outer circumference 87 of the supporting bracket 53 by the elastic force of the compression spring 25. Referring to FIG. 8F, when the supporting bracket 53 is rotated by 180 degree, the locking member 20 rotates in a direction E2 by the elastic force of the compression spring 25, the protrusion 21 is joined with the second joining notch 89, and the supporting bracket 53 is locked so that it does not rotate anymore. Referring to FIGS. 8F and 9I, the TPH 51 is positioned in the first open position, wherein is separated from the platen roller 52 by the first gap G1.

Figure 9J:
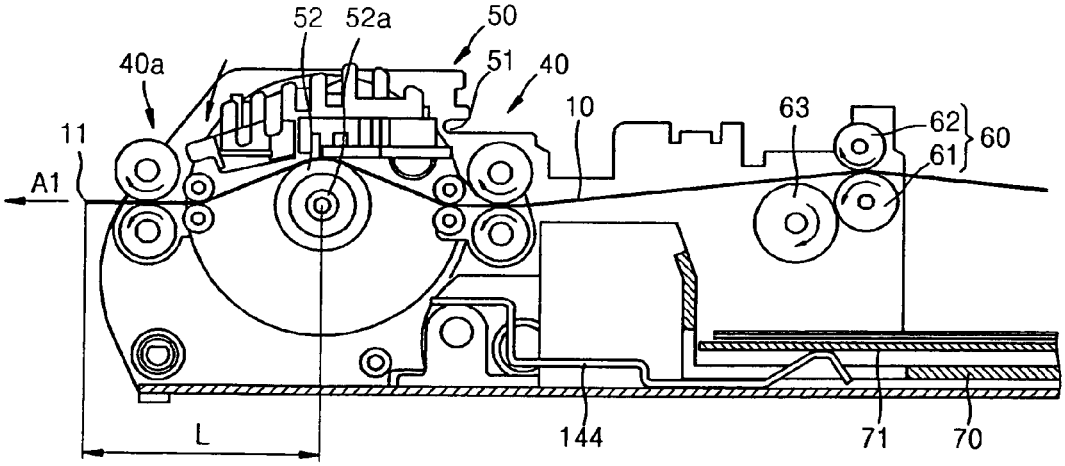

The first feeding unit 40 and the out-feed unit 60 feed the printing medium 10 in the first direction A1. The printing medium 10 is fed to between the TPH 51 and the platen roller 52 through the first gap G1. When the front edge 11 of the printing medium 10 reaches to a position where the printing medium 10 can be fed by the second feeding unit 40*a*, the rotation cam 95 rotates in the direction C1 from a state shown in FIG. 8F. Since the protrusion 21 of the locking member 20 is joined with the second joining notch 89, the supporting bracket 53 does not rotate. The cam lever 84 faces the first cam surface 97*a*, and the TPH 51 is positioned at the second position as shown in FIGS. 8G and 9J. The TPH 51 contacts the platen roller 52 to form the printing nip N. The feeding unit 40*a* feeds the printing medium 10 in the first direction A1 at the predetermined printing speed. The TPH 51 prints an image by heating the second side M2 of the printing medium 10. At this time, the image is not printed on the front edge portion L of the printing medium 10.

Figure 9K:
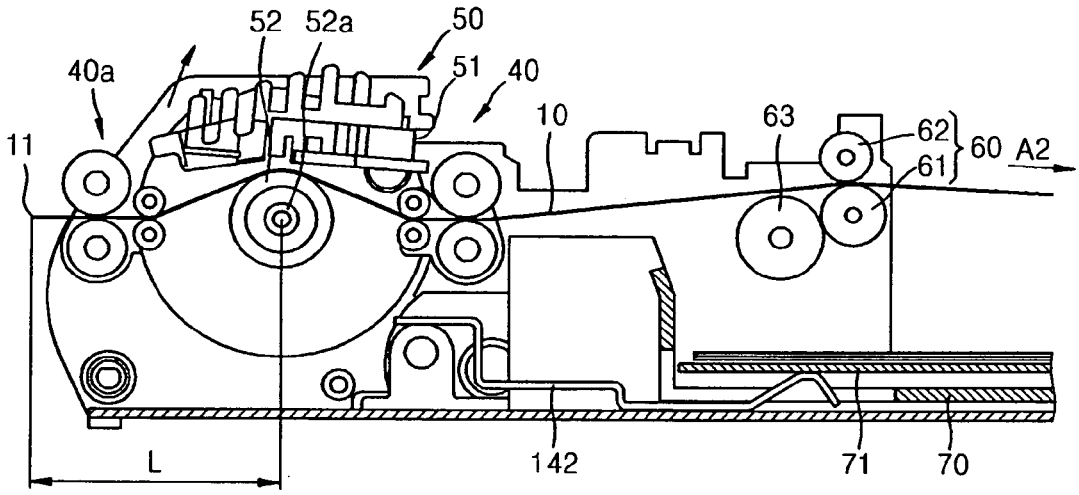
Figure 9L:
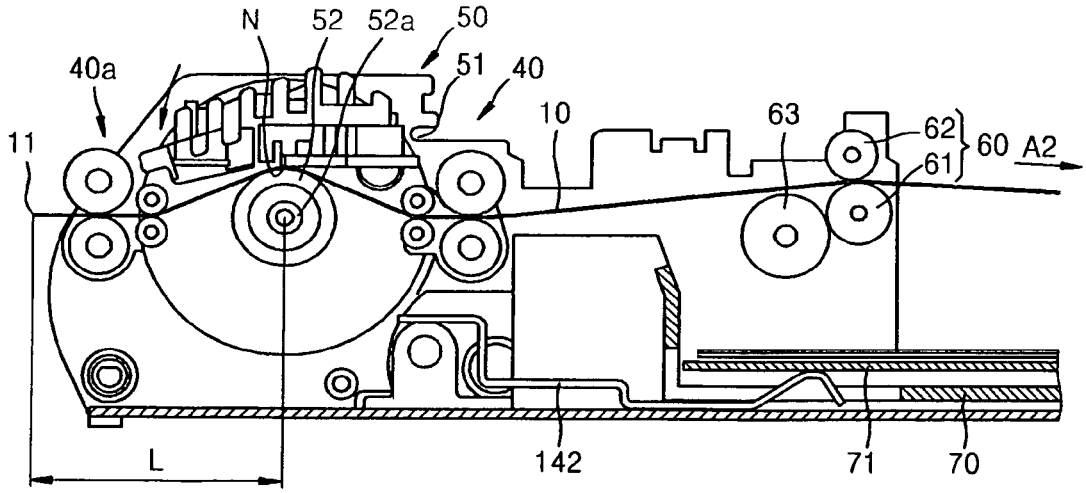

The image is printed on the front edge portion L of the second side M2 of the printing medium 10 by following operations. Referring to FIG. 8G, the rotation cam 95 rotates in the direction C2 to return to the state shown in FIG. 8F. The TPH 51 is positioned at the first open position as shown in FIG. 9K where the first gap G1 is formed between the TPH 51 and the platen roller 52. The second feeding unit 40*a* feeds the printing medium 10 in the second direction A2. The printing medium 10 is fed to between the TPH 51 and the platen roller 52 through the first gap G1. When the front edge portion L of the printing medium 10 reaches to the printing nip N, the printing medium 10 is stopped. The rotation cam 95 rotates again from the state shown in FIG. 8F to the state shown in FIG. 8G, and the TPH 51 is positioned at the printing position as shown in FIG. 9L. The TPH 51 contacts the platen roller 52 to form the printing nip N. The first feeding unit 40 feeds the printing medium 10 in the second direction A2 at the predetermined printing speed. The TPH 51 prints the image by applying heat on the front edge portion L of the printing medium 10. When printing is complete on the first and second sides M1 and M2 of the printing medium 10, the printing medium 10 is fed out by the out-feed unit 60.

When the duplex printing is complete, the rotation cam 95 rotates in the direction C1 in the state shown in FIG. 8G. The third cam surface 97*c* pushes the snag 22 so that the locking member 20 rotates in the direction E1. That is, the third cam surface 97*c* and the stopper 98 are in the blocking state. As a result, the protrusion 21 is separated from the second joining notch 89 and the supporting bracket 53 is released to be able to rotate freely. Therefore, when the rotation cam 95 continuously rotates in the direction C1 and the second cam surface 97*b* pushes the cam lever 84, the supporting bracket 53 rotates in the direction C1. When the blocking state generated between the third cam surface 97*c* and the snag 22 ends, the locking member 20 is continuously held in contact with the outer circumference 87 of the supporting bracket 53 by the elastic force of the compression spring 25. When the supporting bracket 53 rotates 180 degrees, the locking member 20 rotates toward the direction E2 by the elastic force of the compression spring 25 so that the protrusion 21 is joined with the first joining notch 88 where the supporting bracket 53 is locked so that the supporting bracket 53 does not rotate anymore. The TPH 51 is returned to the first position as shown in FIG. 8A.

For example, the base sheet S of the printing medium 10 may be made of a transparent material. An opaque layer, however, may be formed on a surface of either one of the ink layers L1 and L2, for example, the ink layer L1. The TPH 51 prints yellow and magenta images when positioned in the first position and by heating the ink layer L1, while it prints a cyan image when is positioned in the second position and by heating the ink layer L2. From the view point of the ink layer L2, since cyan, magenta, and yellow images are overlapped, a complete color image is recognized.

As another example, if the basic sheet S is made of an opaque material and the same color ink layers are formed on the first and second sides M1 and M2, duplex printing can be realized by printing different images on the first and second sides M1 and M2, respectively.

As described above, the image can be printed on both sides of the printing medium 10 using one TPH 51 by moving the TPH 51 to the first and second positions. In addition, the moving distance of the TPH 51 can be significantly shortened, because the TPH 51 rotates about the platen roller 52. In addition, the stress inflicted on the printing medium 10 while printing can be reduced by moving the TPH 51 to the open position when the printing medium 10 is supplied to the printing nip N. In addition, an apparatus to drive the first and second feeding units 40 and 40*a*, the pick-up roller 63, and the out-feed unit 60 can be simplified by lifting the knock-up plate 71 using the TPH 51 movable to the printing position and the open position.

Accordingly, in an image forming apparatus using one TPH and a printing method thereof according to the present general inventive concept, borderless printing is possible by providing two feeding units. Thus, there is no need to remove a non-printing area after printing is complete, so a shorter printing medium without a non-printing area can be used. In addition, an image forming apparatus capable of borderless duplex printing can be realized by using one TPH.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a thermal printing head (TPH) to form an image on a printing medium;

a platen roller disposed to form a printing nip with the TPH;

feed rollers provided on a first side and a second side of the TPH along a path that the printing medium travels to feed the print medium across the nip in a first direction and a second direction of the path so that the TPH forms a first portion of the image on a first portion of a first side of the printing medium when the printing medium is fed in the first direction and a second portion of the image on a second portion of the first side of the printing medium where the printing medium is fed in the second direction for the first time after printing the first portion of the image on the first portion of the first side of the printing medium;

a frame having a lateral plate;

a supporting bracket rotatably supported by the lateral plate to support the TPH; and a rotation cam to control the supporting bracket with respect to the lateral plate to transfer the TPH to a first position where the TPH can print on a first side of the printing medium and a second position where the TPH can print on a second side of the printing medium.

2. The image forming apparatus of claim 1, wherein, the first and second position having a first open position where the TPH is placed at a first gap, a second open position where the TPH is placed at a second gap, and a printing position where the TPH contacts the printing medium.

3. The image forming apparatus of claim 2, wherein the rotation cam comprises a first cam surface, a second cam surface, and a third cam surface to correspond to the printing position, the first open position, and the second open position, respectively.

4. The image forming apparatus of claim 3, further comprising a hinge shaft and a cam lever provided at the TPH, and wherein:

the supporting bracket comprises a hinge hole and a through hole; the hinge shaft is inserted into the hinge hole and the cam lever is movably inserted into the through hole such that the TPH rotates with respect to the hinge shaft when the cam lever moves along the through hole; and the rotation cam controls the supporting bracket according to a contact with the cam lever.

5. The image forming apparatus of claim 4, wherein the rotation cam controls the supporting bracket to move the TPH between the first open position and the second open position while the TPH faces one of the first and second sides of the printing medium.

6. The image forming apparatus of claim 4, wherein the rotation cam controls the supporting bracket to move the TPH between the first position and the second position.

7. The image forming apparatus of claim 4, wherein the TPH does not rotate with respect to the hinge shaft when the supporting bracket moves between the first and second positions.

* * * * *